US005678718A

United States Patent [19]

Morris et al.

[11] Patent Number: 5,678,718

[45] Date of Patent: Oct. 21, 1997

[54] BOTTLE CAP

[75] Inventors: Dave Morris; Fred Gill, both of Bodmin, Great Britain

[73] Assignee: The West Company Deutschland GmbH, Eschweiler, Germany

[21] Appl. No.: 535,112

[22] PCT Filed: May 5, 1994

[86] PCT No.: PCT/EP94/01452

§ 371 Date: Nov. 6, 1995

§ 102(e) Date: Nov. 6, 1995

[87] PCT Pub. No.: WO94/26613

PCT Pub. Date: Nov. 24, 1994

[30] Foreign Application Priority Data

May 6, 1993 [DE] Germany ..... 43 14 923.5

[51] Int. Cl.[6] ..... B65D 41/32

[52] U.S. Cl. ..... 220/254; 215/254; 215/213; 220/309.1

[58] Field of Search ..... 220/339, 254, 220/309.1; 215/254, 213, 225, 235, 249

[56] References Cited

U.S. PATENT DOCUMENTS

| | | | |
|---|---|---|---|
| 3,893,582 | 7/1975 | Kowalik . | |
| 4,244,478 | 1/1981 | Handman | 215/249 |
| 4,359,166 | 11/1982 | Dubach . | |
| 4,501,372 | 2/1985 | Hansen | 215/249 |
| 4,519,514 | 5/1985 | Agbay et al. . | |
| 4,984,921 | 1/1991 | Hattori | 220/254 |
| 5,027,999 | 7/1991 | Kucherea | 220/254 |
| 5,344,036 | 9/1994 | Stanescu et al. | 215/249 |
| 5,377,853 | 1/1995 | Papciak | 215/249 |
| 5,379,908 | 1/1995 | Rohe | 215/249 |
| 5,464,112 | 11/1995 | Guillot | 220/254 |
| 5,495,941 | 3/1996 | Leonard | 220/254 |
| 5,509,508 | 4/1996 | Wanden et al. | 220/254 |

FOREIGN PATENT DOCUMENTS

| | | |
|---|---|---|
| A-0 291 658 | 11/1988 | European Pat. Off. . |
| A-0 457 107 | 11/1991 | European Pat. Off. . |
| 0S 1 930 126 | 3/1970 | Germany . |
| 8805665 U | 8/1988 | Germany . |
| WO-A-89/08588 | 9/1989 | WIPO . |

*Primary Examiner*—Joseph M. Moy

*Attorney, Agent, or Firm*—Panitch Schwarze Jacobs & Nadel, P.C.

[57] ABSTRACT

The invention relates to a cap (1, 1') for closing a bottle (2) or similar container having a projecting outer annular ridge (10) in the region of its container aperture. The cap (1, 1') has an inner cap section (3) with spring pins (7) which engage the annular ridge (10) of the bottle (2) from under in the closed position and can be secured in this engaged position by an outer cap section (4) in the form of a slide ring. In order to be able to fit or remove such a cap (1, 1') on or from an infusion or transfusion bottle (2) with little effort and to be able to properly recycle the plastic cap material, the invention proposes that the outer cap section (4) have a plurality of security projections (14) around its periphery between which there is a disengagement aperture (26), the outer cap section (4) and the inner cap section (3) are secured together so as not to rotate, when the cap (1, 1') is closed, by means of at least one releasable anti-rotation device and after the anti-rotation device has been released both cap sections can be mutually separated by means of turning and then axially pushing the outer cap section in relation to the inner section (cf. FIG. 5).

16 Claims, 5 Drawing Sheets

Fig.4
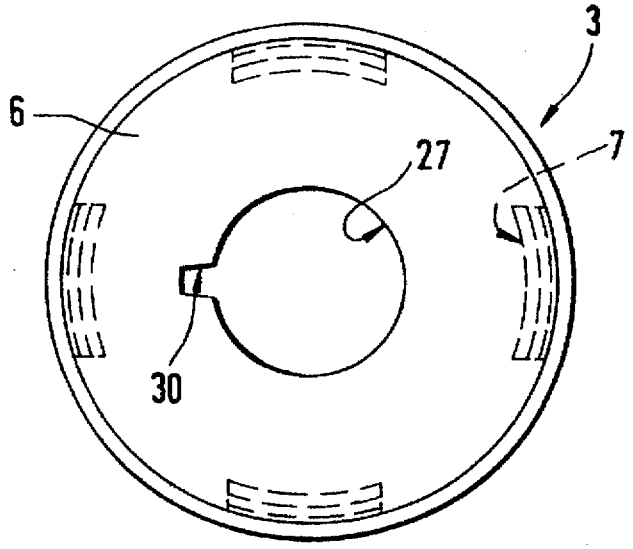
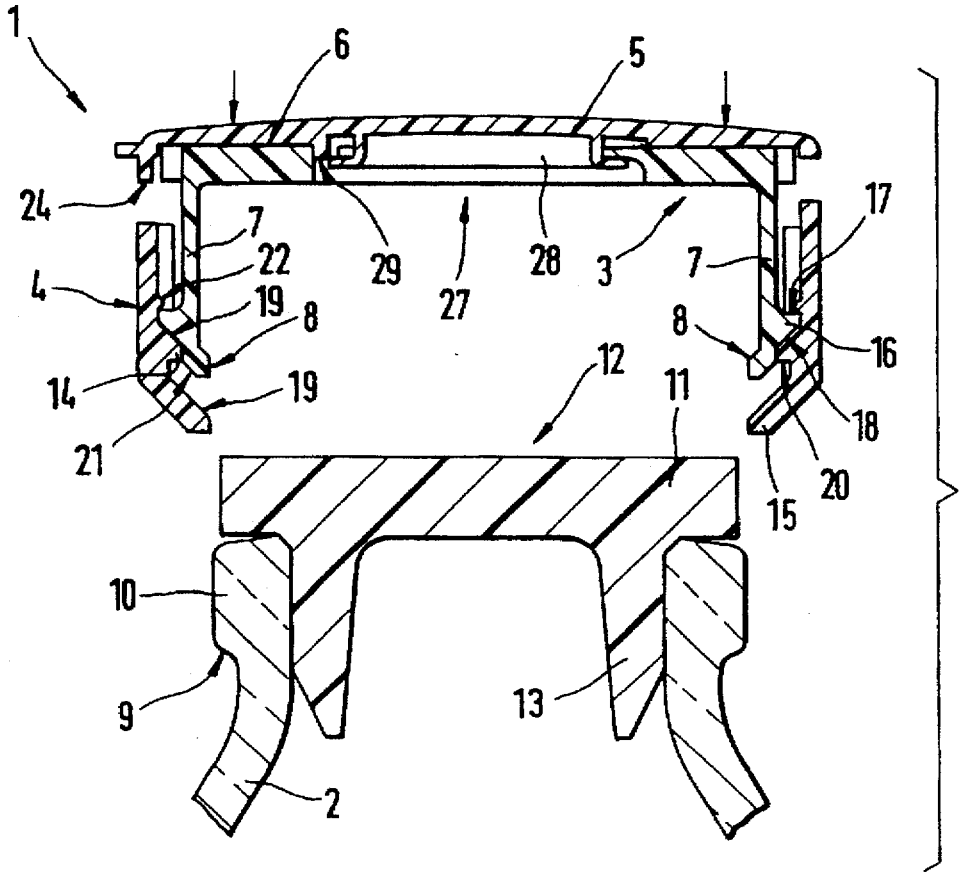
Fig.5

BOTTLE CAP

FIELD OF THE INVENTION

The invention relates to a cap for closing a bottle or similar container having a projecting outer annular ridge in the region of its container aperture, including an inner cap section having a plurality of spring pins each presenting at its free end area an internal retaining projection for engaging behind the annular ridge in a closed position of the cap, including an outer cap section that has a plurality of security projections around the inside of its annular peripheral wall and can be pushed onto the inner cap section in such a way that in the closed position the security projections are located in the area .of the spring pins for securing the latter against a deflecting movement, and further including a sealing element at least partially arranged between the inner cap section and an edge area defining the opening of the bottle or similar container, wherein a disengagement aperture is provided between the security projections on the outer cap section, and wherein after the anti-rotation device has been released both cap sections can be mutually separated by means of turning and then axially pushing the outer cap section in relation to the inner cap section.

BACKGROUND OF THE INVENTION

So-called beaded caps are often used for closing infusion and transfusion bottles. These known beaded caps have an initially cup-shaped cap section placed on the bottle aperture. Provided between the cup-shaped cap section and the edge area defining the bottle aperture is a sealing element in the form of a stopper which is made of elastomeric material and has its cross-sectionally adapted portion pressed into the bottle neck. In order for the beaded cap and the stopper it embraces to be fixed on the bottle neck, the free edge area of the tin cap section is shaped inwards and engages behind the edge of the bottle bead projecting outwards from the bottle neck.

The upper face of the cup-shaped cap section is provided with a circular and generally centrally arranged, penetrable opening defined by rupture joints in the cup-shaped cap section. This penetrable opening can be exposed by removing a top which is firmly connected to the portion of the cup-shaped cap section covering the penetrable opening and is made of plastic material.

To enable that, if required, the contents of the bottle be emptied without any further aid and to permit the various materials of the emptied bottle to then be segregated, the bead of the cup-shaped cap section has to be broken and the closure cap and sealing element have to be detached from the bottle. However sharp edges are often formed or laid bare in this process and may hurt hospital staff, for instance. In addition it is generally not readily possible for the various materials of these known beaded caps to be entirely segregated, because the portion of the tin cap section covering the penetrable opening in the closed position remains at least on the top section. This remaining metal on the top section otherwise consisting of plastic hinders recycling of the plastic material.

German Offenlegungsschrift No. 40 15 510 has disclosed a cap, the constituent sections of which are made entirely of plastic. This cap is held on the bottle by a plurality of spring pins which belong to an inner cap section and each have an internal retaining projection engaging under the bead of the bottle. The inner cap section is secured in the engaged position by an embracing, annular outer cap section. The outer cap section has for this purpose a circumferential, internal security projection supporting the spring pins of the inner cap section in the closed position of the cap. In this closed position, the security projection of the outer cap section in turn engages under locking tongues projecting radially outwardly from the inner cap section, so that the outer and inner cap section are held together immovably in an axial direction.

To enable that the known cap be removed from the bottle and the two cap sections be separated from each other, the outer cap section in the form of a slide ring is provided with a tear tab bounded by two parallel, axially oriented rupture notches in the plastic material of the outer cap section. On the other hand, in the event that the contents of the container are to be removed by means of a needle or transfusion instrument, the exposed end cover of the inner cap section is provided with a penetrable opening defined by two concentric rupture grooves.

Regardless of the material used, such weakened locations or rupture joints have considerable drawbacks. To be able to remove the known cap from the bottle, it has to be destroyed at these rupture joints by hospital staff, producing sharp edges often involving the risk of injury.

In order that the cap is always sure to be destroyed at such rupture joints by the same expenditure of force, it must also be ensured that the wall thickness of these weakened locations remains constant throughout the service life of such a mould. If the wall thickness of this weakened location is increased by wear of the mould or by other faults affecting the production process, cap removal from the bottle is no longer possible or only by expending far more force. If, on the other hand, the weakened location becomes too thin, the cap breaks there already when being fitted onto the bottle.

Such weakened locations are made by corresponding constrictions in the injection mould. The polypropylene plastic envisaged for producing the cap according to German Offenlegungsschrift No. 40 15 510, however, has long molecular chains which undergo polarization when flowing through these constrictions. The orientation of the molecular chains means that in the area of the weakened locations material fibres are formed which actually counteract any rupture of the plastic material and may substantially impede separation of the various cap sections.

Furthermore the cap of German Offenlegungsschrift No. 40 15 510 has to be fitted on a bottle neck in several working steps. In a first working step the elastomeric stopper has to be pressed into the bottle aperture from above. In a further working step the inner cap section is then pressed from above onto the bottle aperture and stopper on it, and whilst doing so the spring pins of the inner cap section are temporarily deflected outwardly as they pass the annular ridge defining the bottle aperture and then spring into their unstressed position engaging under the bottle bead. In a following working step the outer cap section is pushed onto the inner cap section and the spring pins are thereby secured in their engaging or closed position.

In contradistinction to the fitting of conventional beaded caps, in which the bead has to be shaped inwardly sidewards from beneath, the various cap sections of the cap known from German Offenlegungsschrift No. 40 15 510 have to be successively placed on the bottle from above. Therefore bottle capping machines designed accordingly are necessary to be able to carry out these working steps.

U.S. Pat. No. 4,359,166 has disclosed a cap of the kind mentioned at the outset, having an inner cap section and an annular outer cap section, both likewise of plastic. The inner cap section is provided with a plurality of spring pins each having arranged at its free end area a retaining projection engaging behind the annular ridge provided at a bottle neck. To secure the spring pins against a deflecting moverment, the outer cap section can be pushed onto the inner cap section. These cap sections are then mutually separable by means of turning and then axially pushing the outer cap section relative to the inner cap section. In counteract any unintended rotation of the two cap sections in the closed position of the known cap, an anti-rotation device is provided in the form of a separate securing tab welded or similarly fastened externally to the inner cap section on the one hand and to the outer cap section on the other hand. This anti-rotation device of the cap is however elaborate and calls for several extra production steps.

SUMMARY OF THE INVENTION

Therefore the object underlying the invention is particularly to provide a cap of the kind mentioned at the outset, which can be easily fitted or removed and requires comparatively little expenditure for producing or fitting.

According to the invention this object is accomplished for a cap of the kind mentioned at the outset in that the cap has a top section which is in the form of tamper evident closure for the penetrable opening in the face of the inner cap section and is non-rotatably and releasably connected to the inner cap section, and that the anti-rotation device between the cap sections has corresponding securing means, at least one securing means thereof being provided on the outer cap section and the other securing means co-operating therewith being provided on the top section.

In the closed position of the cap embodied by the invention, the top section is non-rotatably connected to the inner cap section on the one hand and to the outer cap section on the other hand. The top section therefore secures the non-rotatable unit it and the two cap sections form. Releasing the top section from the inner cap section simultaneously renders the non-rotatable connection between the inner and outer cap sections inoperative, so that these cap sections are mutually separable by means of turning and then axially pushing the outer cap section relative to the inner cap section. This turning-pushing movement permits the cap embodied by the invention to be detached from the bottle or similar container easily and without any danger of injury.

To remove the cap embodied by the invention from a bottle or similar container, it is necessary only to release the top section and turn the inner cap section relative to the outer cap section in order to then be able to separate these two parts by pushing axially. The turn means that the retaining projections provided on the spring pins of the inner cap section are moved out of the area of the security projections into the area of the disengagement openings distributed over the inside periphery of the wall of the outer cap section. These disengagement openings, which form the space between the adjacent security projections, enable the retaining projections of the spring pins to be moved in an axial direction so as to depart from the engaging area of the security projections provided on the other cap section. Through the bayonet joint-type denticulation of the outer and inner cap section, the two sections can be easily and virtually non-destructively separated and recycled.

Since no rupture joints are necessary for separating the two cap sections, weakened locations leading in the plastic material to undesired orientation of material fibres and to sharp edges can be dispensed with in the cap embodied by the invention. Medical staff can therefore easily remove the cap embodied by the invention without hurting themselves on such sharp edges. At the same time the component parts of the cap embodied by the invention can be easily segregated and recycled by type. The plastic material solely used is also obtained as waste elsewhere in a hospital in the form of syringes or similar plastic parts, whereas there is no use of aluminium material provided mainly only for conventional beaded caps.

Since the cap embodied by the invention essentially consists only of three parts, its manufacture and fitting involve little expenditure. Simply releasing the top section from the two cap sections of the cap embodied by the invention renders inoperative the anti-rotation device provided between the cap sections and exposes the penetrable opening provided on the face of the inner cap section. The filling of the bottle or similar container can therefore be removed either by completely removing the cap or for instance by means of a syringe needle through the penetrable opening of the inner cap section.

It is suitable if in the unstressed initial position the inner cap section has in the region of its retaining projections an inside diameter corresponding at least approximately to the outside diameter of the annular ridge of the bottle or the like and if the spring pins of the inner cap section are movable into their sprung back holding position in the closed condition by an axial relative movement of inner and outer cap section by means of at least one incline provided on the inner and/or outer cap section.

Since in its unstressed initial position the inner cap section has an inside diameter corresponding at least approximately to the outside diameter of the annular ridge of the bottle or the like, the inner cap section can be placed on the bottle without virtually any effort when fitting the cap embodied by the invention. The spring pins provided on the inner cap section are moved into their holding position not before for example the outer cap section is pushed from beneath onto the inner cap section. The caps embodied by the invention can also be processed on conventional bottle capping equipment since the working steps necessary for fitting them and particularly the lateral upward sliding movement envisaged for connecting the inner cap section to the outer cap section correspond to the common procedure for conventional beaded caps.

A preferred further development of the invention, protectable in its own right, proposes that at least one projection provided between the inner and the outer cap section holds them in a preassembled, prelocked position in which the spring pins are in their open position, and that the cap sections are movable into the closed position of the cap by axially moving the outer cap section in relation to the inner cap section. The cap essentially comprising the inner cap section, the outer cap section and the top section can be supplied in a preassembled, prelocked position and placed upon the infusion bottle. The two cap sections then only have to be moved axially in relation to each other in order to close the cap and the container it seals. This embodiment further promotes the simple fitting of the cap according to the invention.

It is suitable if the top section has at least one anti-rotation projection or similar moulding engaging with an associated guard opening or similar recess of the outer cap section in the closed position of the cap. The securing means in the form of the anti-rotation projection is preferably integrally moulded to the top section. The top section may be provided with at least one securing means co-operating with the outer cap section and at least one co-operating with the inner cap section as a safeguard against rotation. However, it is beneficial for the low expenditure in producing the cap embodied by the invention if the securing means provided on the top section is assigned for securing the top section and inner cap section against rotation and for securing the top section and outer cap section against rotation.

A further embodiment of the invention proposes that the anti-rotation projection of the top section engages with a guard opening or similar recess of the inner cap section in the closed position of the cap and that the recesses of the cap sections associated to the anti-rotation projection correspond to one another in a rotary position of said cap sections.

A further development of the invention proposes that the top section has projecting from its face confronting the inner cap section at least one arresting hook, preferably a plurality of arresting hooks, said hooks traversing the penetrable opening of the inner cap section and having their outwardly angled or similarly projecting free ends engaging behind the edge area defining the penetrable opening of the inner cap section. The top section is releasably held on the inner cap section by means of the arresting hooks, without there being need for any weakened locations or rupture joints possibly hard to sever between top and inner cap section.

The inner cap section is immovably connected to the outer cap section in the closed position if each spring pin is provided in its free end area with an external, arresting projection, in the closed position of the cap said projection being held between two security projections which are in spaced relationship to each other in the sliding direction and are arranged internally on the annular wall portion of the outer cap section.

To preassemble the component parts it is suitable if the associated security projections are preceded in the sliding direction by a prelocking lug and if in the preassembled, prelocked position of the cap the spring pins of the inner cap section are held with their arresting projection between said prelocking lug and the adjacent security projection of the outer cap section.

An embodiment of the invention proposes that for non-rotatable guidance of the arresting projections in the sliding direction there is a guiding strip oriented in the sliding direction provided between and on either side of at least one of the prelocking lugs and the adjacent security projection, and that at least one of the two associated guiding strips preferably extend(s) proximate to that edge area of the outer cap section which faces the top section. The component parts of the cap embodied by the invention are therefore already non-rotatably interconnected in their preassembled position. In the closed position of the cap, the anti-rotation device provided on the top section, for instance, engages with the respective recess of the outer cap section, so that the component parts of the cap embodied by the invention are non-rotatably held together as long as the top section has not been removed from the inner cap section.

It is suitable if in each case one guiding strip extending proximate to the edge area of the outer cap section facing the top section is provided on the same side of all the projections of the outer cap section and if two adjacent guiding strips extending to the top section bound a guard opening or similar recess of the outer cap section.

In order for the two cap sections to assume their prelocking and then their closed position with the minimum expenditure of force, an embodiment of the invention proposes that that flank of the arresting projections which points to the top section is arranged approximately at right angles to the longitudinal axis of the spring pin, and that the opposite flank of each arresting projection slopes inwardly towards the free end of the spring pin. Simple fitting of the two cap sections is further promoted if at least the security projections facing the top section, preferably both associated security projections, have their flanks pointing to the top section sloping inwardly towards the container, and if the opposite flanks at least of the security projections facing the top section are preferably arranged approximately at right angles to the longitudinal axis of the annular wall portion of the outer cap section.

The retaining projections of the spring pins are urged particularly securely and firmly against the locking shoulder of the annular ridge provided in the area of the bottle aperture if in the closed position the spring pins are applied to the sloping flank(s) of the security projection(s) facing away from the top section with a corresponding companion face provided at the free end area of the spring pins.

A preferred embodiment of the invention, which lends itself particularly well to recycling the cap material used, proposes that the inner cap section, outer cap section and top section are made of plastic, particularly of polypropylene.

BRIEF DESCRIPTION OF THE DRAWINGS

Further features of the invention follow from the description given below of an exemplary embodiment of the invention taken in conjunction with the claims and drawings. The various features may be realized singly or severally in an embodiment of the invention.

The drawings show on different scales in

FIG. 4 is a plan view onto the top surface of the inner cap section of the cap depicted in FIGS. 1 to 3, the inner cap section being adapted to be pushed into the outer cap section, FIG. 5 is a cross sectional view of the preassembled outer cap section, inner cap section and top section of the cap depicted in FIGS. 1 to 4, these component parts of the cap being situated above a bottle with a stopper as sealing element pressed into its bottle neck.

DETAILED DESCRIPTION OF PREFERRED EMBODIMENTS

Figure 1:
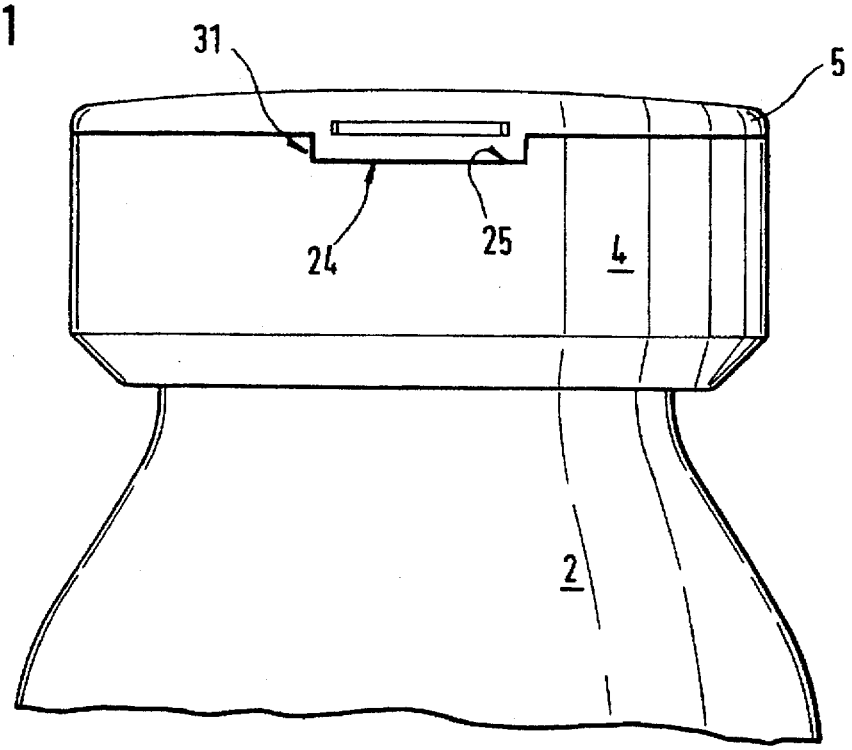
FIG. 1 a side view of an infusion or transfusion bottle closed by means of a cap with a top section held on the outer cap section.
Figure 2:
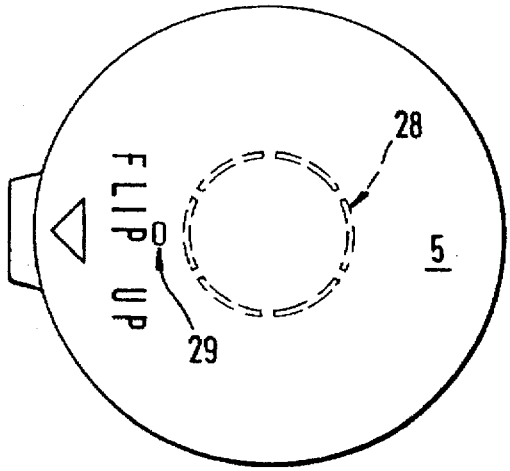
FIG. 2 is a plan view of the top section of the cap.
Figure 3:
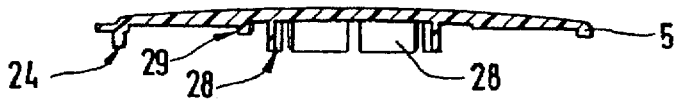
FIG. 3 is a cross sectional view of the top section.

FIGS. 1 to 10 depict a cap 1 for closing an infusion or transfusion bottle 2. The cap 1 essentially consists of an inner cap section 3, an outer cap section 4 and a top section 5.

The inner cap section 3 has an upper cover plate 6 integrally formed with four spring pins 7 arranged crosswise at right angles to the plane of the plate. Each of these spring pins 7 has at its free end area a retaining projection 8 which is angled inwards and projects beyond the inside of the spring pin 7. In the closed position of the cap 1, the retaining projections 8 of the spring pins 7 engage behind or under the annular shoulder 9 which faces away from the cap 1 and forms part of an annular ridge 10 of the bottle 2. The spring pins 7 are dimensioned such that located between the cover plate 6 and the edge area defining the bottle aperture is the outwardly projecting flange 11 of a stopper 12 in the form of a sealing element, the cylindrical stopper portion 13 of adapted shape being pressed tightly into the bottle aperture.

The outer cap portion 4 of the bottle cap 1 is essentially in the form of an annular wall portion, internally provided with a plurality of security projections 14, 15. To secure the spring pins 7 against a deflecting movement directed radially outwardly, the outer cap section 4 is adapted to be pushed onto the inner cap section 3 in such a way that the security projections 14, 15 are at the free end area of the spring pins 7 in the closed position illustrated in FIG. 7.

Figure 6:
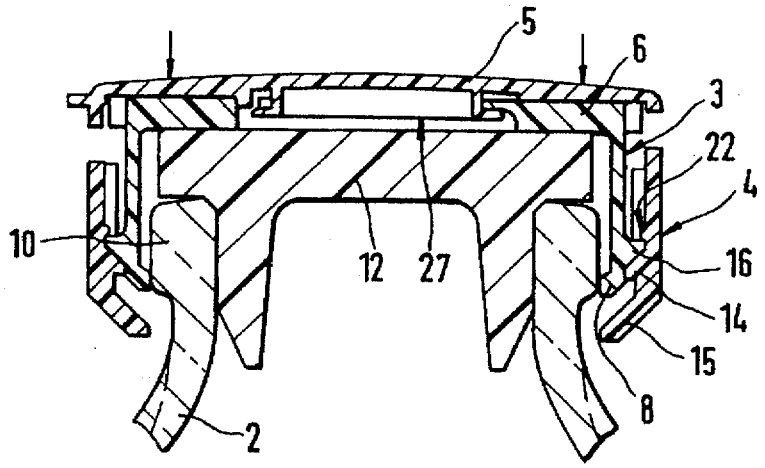
FIG. 6 shows the component parts of the cap placed upon the bottle aperture in a preassembled, prelocked position.
Figure 7:
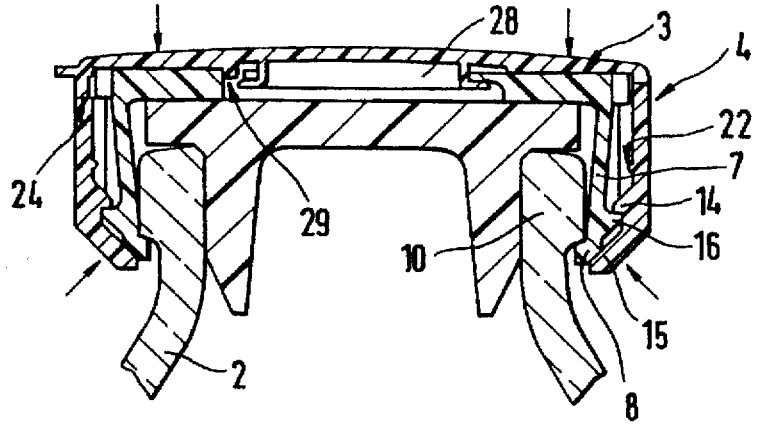
FIG. 7 is the closure cap in its closed position in which the inner cap section and outer cap section are interconnected so as to be axially immovable and non-rotatable.

The inner cap section 3, in its unstressed initial position shown by way of example in FIGS. 5 and 6, has an inside diameter corresponding approximately to the outside diameter of the annular ridge 10 of the bottle 2. In this unstressed initial position the inner cap section 3 can be placed upon the bottle aperture without virtually any resistance. As FIGS. 5 to 7 show, each spring pin 7 is externally provided with an arresting projection 16. Each flank 17 of projection 16 pointing to the top section is arranged approximately at right angles to the longitudinal axis of the spring pin 7. The opposite flank 18 of each arresting projection 16 slopes inwardly towards the free end of the respective spring pin 7. Associated to each of the spring pins 7 is a security projection 14 adapted in width to approximately that of the spring pin 7. That flank 19 of each of these security projections 14 which points to the top section 5 slopes inwardly in the direction of the bottle 2, while the opposite flank 20 is arranged approximately at right angles to the longitudinal axis of the outer cap section 4.

Provided in an axial direction towards the bottle 2 is a further security projection 15 in the form of a circumferential security ring 15, here composed by the annular outer cap section 4 at the inwardly angled end area thereof facing the bottle. In the same way as the flanks 18, 19 of projections 14, 16, this projecting security ring 15 forming part of the outer cap section 4 and facing away from the top section 5 composes an inwardly directed incline causing the spring pins 7 of the inner cap section 3 to be deflected inwardly during an axial relative movement of the cap sections 3, 4. For this purpose the free ends of the spring pins 7 present an external, corresponding, inclined companion surface 21 capable of sliding inwardly on that flank of the security ring 15 which faces the top section 5 and is inclined inwardly towards the bottle 2.

The inclined flanks 18, 19 on the associated arresting and security projections 16, 14 also act in the same way. In the axial direction the distance between the security projections 14 and the retaining ring 15 is dimensioned such that when the bottle cap 1 is closed the portion of spring pin 7 located between companion surface 21 and arresting projection 16 is held axially immovably between the two security projections 14, 15.

The security projections 14, 15 are each preceded in the sliding direction by a prelocking lug 22 likewise adapted in the circumferential direction to the width of the respective spring pin 7. If required, the inner cap section 3 can be initially pushed into the outer cap section 3 only to such an extent that the arresting projections 16 on the spring pins 7 are held between the associated prelocking lug 22 and the adjacent security projection 14 of the outer cap section 4. A recess for engagement with the respective arresting projection is formed between the prelocking lug 22 and security projection 14. The cap can be supplied to consumers in this preassembled, prelocked position and there be placed in this condition upon the bottle apertures.

Figure 9:
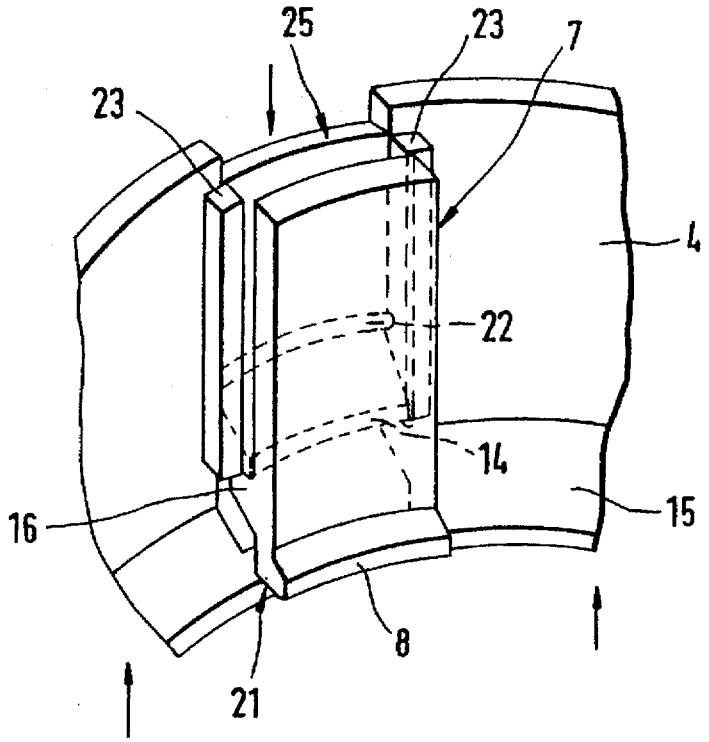
FIG. 9 is the spring pin held to the outer cap section in the closed position of the cap.

As FIGS. 7 and 9 show, the cap 1 can be moved from the prelocked position into the closed position by merely applying pressure laterally from beneath in the direction of the stationary top section 5. For so doing, the cap 1 can be processed on existing equipment which is designated for aluminium beading of beaded caps and has practically all the functions necessary for closing the cap 1 illustrated here.

Figure 8:
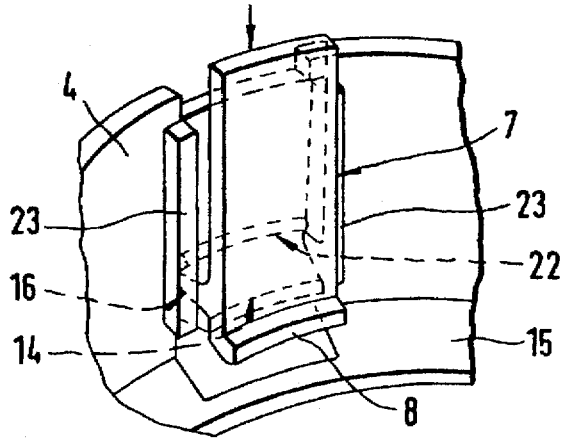
FIG. 8 is a spring pin of the inner cap section, held to the outer cap section in the prelocked position, with only a partial view of the inner and outer cap sections.
Figure 10:
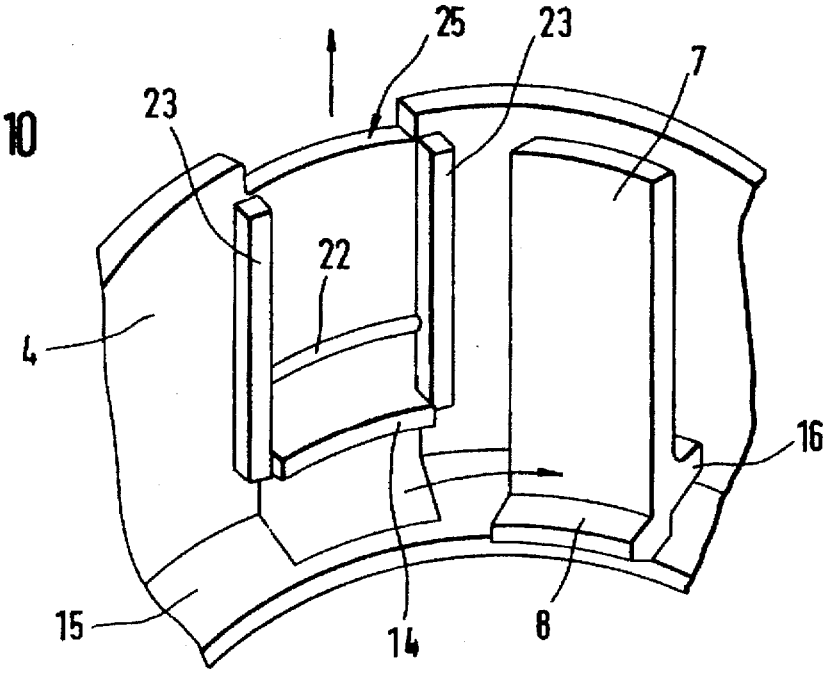
FIG. 10 is the spring pin of the inner cap section disengageable from the outer cap section by means of turning and then moving axially.

As FIGS. 8 to 10 show, guiding strips 23 oriented in the sliding direction are provided on either side of the security projections 14 and prelocking lugs 22 and extend proximate to that edge area of the outer cap section 4 which faces the top section 5. These guiding strips 23 prevent the two cap sections 3, 4 from turning until their prelocking position.

In the closed position shown in FIGS. 1 and 7, an integral moulding serving as an anti-rotation device 31 or similar anti-rotation projection (24) protruding axially from the edge of the top section 5 engages with an open-ended recess 25 of complementary shape in the outer cap section 4. The top section 5 releasably held on the inner cap section 3 safeguards the inner cap section 3 non-rotatably connected thereto from turning relative to the outer cap section 4 in the closed position. Through this non-rotatable connection of components 3, 4 in the closed position of the cap 1, the arresting projections 16 of the spring pins 7 are also secured in their holding position shown in FIGS. 7 and 9. Releasing the top section 5 from the inner cap section 3 renders the non-rotatable connection between the two cap sections 3, 4 inoperative. Since the guiding strips 23 extend only to the level of the security projections 14, by turning the outer cap section 4 in relation to the inner cap section 3 the arresting projections 16 can be turned out of their engaged position and moved into the area of the disengagement apertures 26 each formed by the space which is provided between two adjacent security projections 14 and extends up to the top section 5. By means of a subsequent axial sliding movement indicated in FIG. 10, the cap sections 3, 4 can then be separated from each other and from the bottle 2 and recycled.

The flip-up top section 5, which takes the form of a tamper evident closure for the penetrable opening 27 in the face of the inner cap section 3, can easily be released from the latter. For this purpose top section 5 has projecting approximately centrally from its face confronting the inner cap section 3 at least one arresting hook 28, in the case of the presently illustrated cap a plurality of arresting hooks. The arresting hooks 28 traverse the penetrable opening 27 and their outwardly angled free ends engage behind the edge area defining the penetrable opening 27 of the inner cap section 3. The angled free end of the arresting projections 28, which may be for instance thermally shaped, can be easily released from the inner cap section 3, but not re-attached. A retaining pin 29 projects from the face of the top section 5 and engages with an appropriate recess 30 in the inner cap section 3 to non-rotatably connect the cap section 3 to the top section 5.

Through the bayonet joint-type connection between the inner and outer cap sections 3, 4 and through the releasable connection of the top section 5 to the inner cap section 3 by means of the arresting hooks 28, rupture joints or similar weakened locations on the components 3, 4, 5 of the cap 1 can be dispensed with.

Releasing the top section 5 from the inner cap section 3 opens the penetrable opening 27 in the inner cap section and locally exposes the stopper 12 in order to be able to remove the contents from the bottle 2 by means of a needle or transfusion instrument. If, on the other hand, the contents of the bottle 2 are to be poured out direct, then it is necessary only to remove the top section 5, turn and then axially push the cap sections 3, 4 in relation to each other in order to completely remove the cap 1 and expose the aperture of the bottle 2.

When the bottle 2 is fully opened and the cap 1 is removed no sharp edges are formed or exposed which are liable to hospital staff for instance.

Figure 11:
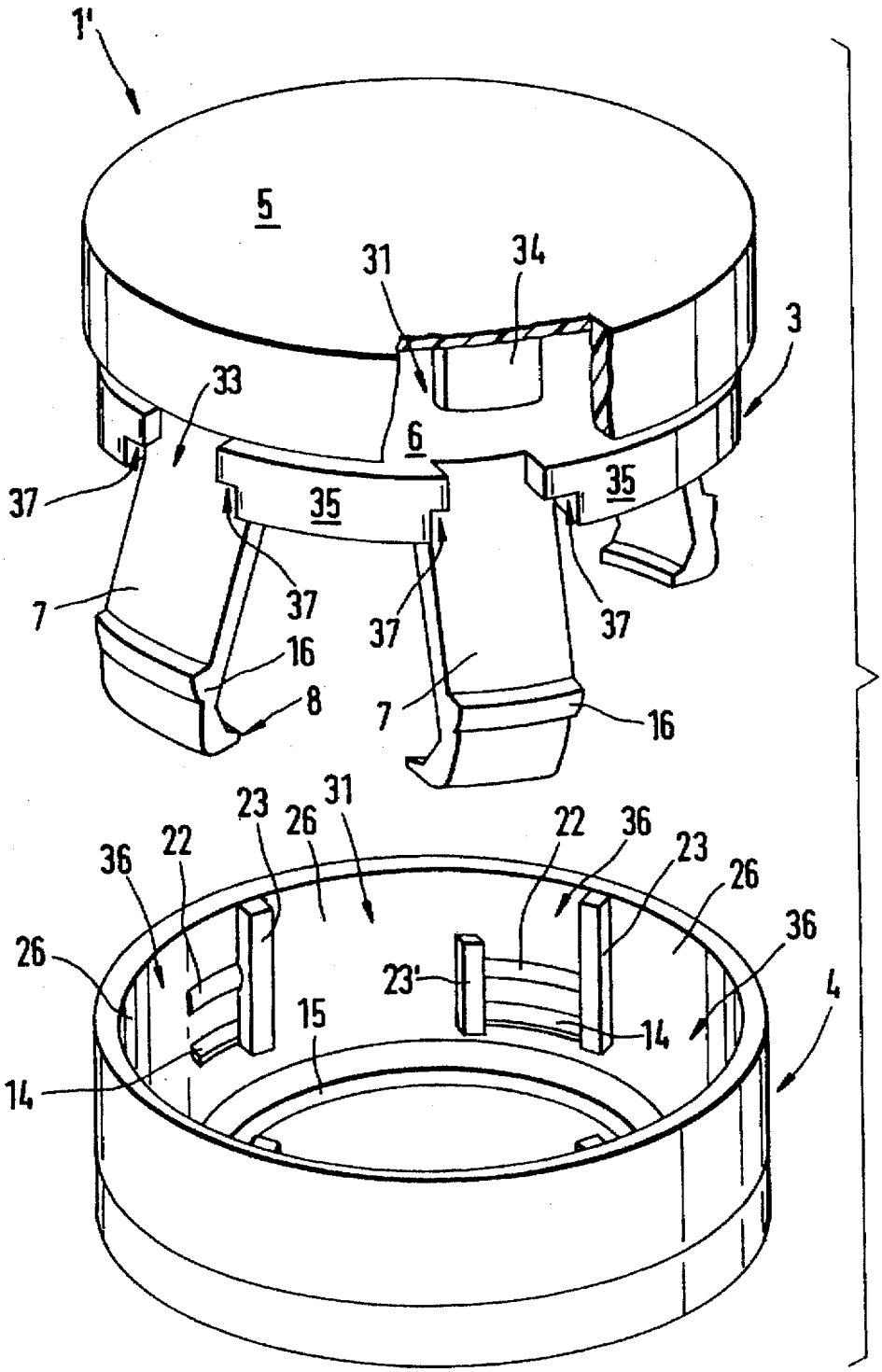
FIG. 11 is a preferred embodiment of a cap, similar to that of FIGS. 1 to 10.

FIG. 11 depicts the preferred embodiment of a bottle cap 1' in a drawn apart view. The bottle cap 1' of FIG. 11 very largely corresponds to the bottle cap 1 illustrated in FIGS. 1 to 10.

The top section 5 of the cap 1' also has a plurality of arresting hooks 28 (not shown) of circular arrangement, which traverse the likewise circular penetrable opening 27 of the inner cap section 3 and have their outwardly angled free ends engaging behind the edge area defining this penetrable opening 27 of the inner cap section 3.

The partly broken away view of top section 5 in FIG. 11 illustrates that the inner face of this top section 5 has an integral moulding or similar anti-rotation projection 34. The inner cap section 3 has on its cover plate 6 in the region of each spring pin 7 an open-ended guard opening or similar recess 33. The tab-like anti-rotation projection 34 and the recesses 33 are adapted to one another in shape in such a way that the anti-rotation projection 34 can engage with one of the recesses 33. Through the anti-rotation projection 34 engaging with one of the recesses 33, the top section 5 and inner cap section 3 are non-rotatably and nevertheless releasably interconnected.

The outer cap section 4 of the cap 1' also has around its inner periphery the security projections 14, 15, preceded in the sliding direction by the prelocking lug 22. For the arresting projections 16 arranged on the spring pins 7 to be non-rotatably guided in the sliding direction, a guiding strip 23, 23' oriented in the sliding direction is provided between and on either side of a prelocking lug 22 and the security projection 14 adjacent thereto. Whereas the lefthand guiding strip 23' in FIG. 11 is arranged only in the area between the prelocking lug 22 and the adjacent security projection 14, the associated righthand guiding strip 23 in FIG. 11 extends proximate to that edge area of the outer cap section 4 which faces the top section 5.

Such a guiding strip extending proximate to the top section 5 is provided on one and the same side of all of the projections 14, 22. Whereas the guiding strips 23, 23' are provided on either side of only one pair of associated projections 14, 22, the guiding strip 23 extending to the top section 5 is only on one side of the other projections 14, 22.

The guard openings or similar recesses 33 of the inner cap section 3 are bounded by circular arc-shaped projections 35. In the closed position of the cap 1' these projections 35 of the inner cap section 3 engage with the guard openings or similar recesses 36 which form part of the outer cap section 4 and are bounded by the mutually adjacent guiding strips 23 extending proximate to that edge area of the outer cap section 4 which faces the top section 5.

In case of any relative movement between the inner and the outer cap section 3, 4, the projections 35 strike against the guiding strips 23 and limit further rotation. The guiding strips 35 thereby come to rest in a recess 37 of adapted shape in the projections 35. When, in the closed position of the cap 1', the anti-rotation projection 34 provided on the top section 5 engages with the associated guard openings 33, 36 of the inner and outer cap section 3, 4, one of the guiding strips 23 is held in the corresponding recess 37 of the projection 35.

Since at the same time the anti-rotation projection 34 provided on the top section 5 and one of the adjacent projections 35 fill up one of the guard openings 36 on the outer cap section 4, the cap sections 3, 4 and the top section 5 are connected to form a non-rotatable unit in this closed position of the cap 1' The anti-rotation projection 34 on the top section 5 simultaneously safeguards the anti-rotation device 31 provided between the cap sections 3, 4. By releasing the top section 5, the anti-rotation projection 34 can be removed from the guard opening 36 of the outer cap section 4 to release the anti-rotation device 31 between the cap sections 3, 4. The cap sections 3, 4 can be removed from the bottle or similar container simply and with little effort by then turning and pushing them, releasing the arresting projections 16 on the spring pins 7 from their engagement between the security projections 14, 15 and pushing them out of their disengagement aperture 26.

After the caps 1, 1' have been removed from the bottle 2, the various materials can be recycled by type. Since the component parts 3, 4, 5 of the caps 1, 1' are made of plastic, preferably of polypropylene plastic, no further materials, e.g. aluminium sheet, arises.

The caps 1, 1' can be fitted on or removed from an infusion or transfusion bottle or similar container with little effort. The cap material used for producing the component parts 3, 4, 5 of the cap can be easily segregated and properly recycled.

We claim:

1. A cap (1, 1') for closing a bottle (2) or similar container having a projecting outer annular ridge (10) in the region of its container aperture, including an inner cap section (3) having a plurality of spring pins (7) each presenting at its free end area an internal retaining projection (8) for engaging behind the annular ridge (10) in a closed position of the cap (1, 1'), including an outer cap section (4) that has a plurality of security projections (14) around the inside of its annular peripheral wall and can be pushed onto the inner cap section (3) in such a way that in the closed position the security projections (14) are located in the area of the spring pins (7) for securing the latter against a deflecting movement, and further including a sealing element (12) at least partially arranged between the inner cap section (3) and an edge area defining the opening of the bottle (2) or similar container, wherein a disengagement aperture (26) is provided between the security projections (14) on the outer cap section (4), and wherein after the anti-rotation device (31) has been released both cap sections (3, 4) can be mutually separated by means of turning and then axially pushing the outer cap section (4) relative to the inner cap section (3), characterized in that the cap (1, 1') has a top section (5) which is in the form of a tamper evident closure for a penetrable opening (27) in the face of the inner cap section (3) and is non-rotatably and releasably connected to the inner cap section (3), and that the anti-rotation device (31) between the cap sections (3, 4) has corresponding securing means, at least one securing means thereof being provided on the outer cap section and the other securing means (24, 34) cooperating therewith being provided on the top section (5).

2. A cap as claimed in claim 1, characterized in that in the unstressed initial position the inner cap section (3) has in the region of its retaining projections (8) an inside diameter corresponding at least approximately to the outside diameter of the annular ridge (10) of the bottle (2) or the like, and that the spring pins (7) of the inner cap section (3) are movable into their sprung back holding position in the closed condition by an axial relative movement of inner and outer cap section (3, 4) by means of at least one incline provided on the inner and/or outer cap section (3, 4).

3. A cap as claimed in claim 1, characterized in that at least one projection provided between the inner and outer cap section (3, 4) holds them in a preassembled, prelocked position in which the spring pins (7) are in their open position, and that the cap sections (3, 4) are movable into the closed position of the cap (1, 1') by axially moving the outer cap section (4) in relation to the inner cap section (3).

4. A cap as claimed in claim 1, characterized in that the top section (5) has at least one anti-rotation projection (24, 34) engaging with an associated guard opening (25, 36) or similar recess of the outer cap section (4) in the closed position of the cap (1, 1').

5. A cap as claimed in claim 1, characterized in that the anti-rotation projection (34) of the top section (5) engages with a guard opening or similar recess (33) of the inner cap section (3) in the closed position of the cap (1') and that the recesses (33, 36) of the cap sections (3, 4) associated to the anti-rotation projection (34) correspond to one another in a rotary position of said cap sections (3, 4).

6. A cap as claimed in claim 1, characterized in that the top section (5) is non-rotatably connected to the inner cap section (3).

7. A cap as claimed in claim 1, characterized in that the top section (5) has projecting from its face confronting the inner cap section (3) at least one arresting hook, preferably a plurality of arresting hooks (28), said hooks traversing the penetrable opening (27) of the inner cap section (3) and having their outwardly angled or similarly projecting free ends engaging behind the edge area defining the penetrable opening (27) of the inner cap section (3).

8. A cap as claimed in claim 1, characterized in that each spring pin (7) is provided in its free end area with an external, arresting projection (16), in the closed position of the cap (1, 1') said projection being held between two security projections (14, 15) which are in spaced relationship to each other in the sliding direction and are arranged internally on the annular wall portion of the outer cap section (4).

9. A cap as claimed in claim 1, characterized in that the associated security projections (14, 15) are preceded in the sliding direction by a prelocking lug (22), and that in the preassembled, prelocked position of the cap (1, 1') the spring pins (7) of the inner cap section (3) are held with their arresting projection (16) between said prelocking lug (22) and the adjacent security projection (14) of the outer cap section (4).

10. A cap as claimed in claim 1, characterized in that for non-rotatable guidance of the arresting projections (16) in the sliding direction there is a guiding strip (23, 23') oriented in the sliding direction provided between and on either side of at least one of the prelocking lugs (22) and the adjacent security projection (14), and that at least one of the two associated guiding strips (23) preferably extend(s) proximate to that edge area of the outer cap section (4) which faces the top section (5).

11. A cap as claimed in claim 1, characterized in that in each case one guiding strip (23) extending proximate to the edge area of the outer cap section (4) facing the top section (5) is provided on the same side of all the projections (14, 22) and that two adjacent guiding strips (23) extending to the top section (5) bound a guard opening or similar recess (36) of the outer cap section (4).

12. A cap as claimed in claim 1, characterized in that that flank (17) of the arresting projections (16) which points to the top section is arranged approximately at right angles to the longitudinal axis of the spring pin (7), and that the opposite flank (18) of each arresting projection (16) slopes inwardly towards the free end of the spring pin (7).

13. A cap as claimed in claim 1, characterized in that at least the security projections (14) facing the top section (5), preferably both associated security projections (14, 15), have their flanks (19) pointing to the top section (5) sloping inwardly towards the container (2), and that the opposite flanks (20) at least of the security projections (14) facing the top section (5) are preferably arranged approximately at right angles to the longitudinal axis of the annular wall portion of the outer cap section (4).

14. A cap as claimed in claim 1, characterized in that in the closed position the spring pins (7) are applied to the sloping flank(s) (19) of the security projection(s) facing away from the top section (5) with a corresponding companion face (21) provided at the free end area of the spring pins (7).

15. A cap as claimed in claim 1, characterized in that the security projection (15) facing away from the top section (5) takes the form of a circumferential security ring.

16. A cap as claimed in claim 1, characterized in that the inner cap section (3), the outer cap section (4) and the top section (5) are made of plastic, preferably of polypropylene plastic material.

* * * * *